United States Patent [19]

Bowman

[11] 3,930,740

[45] Jan. 6, 1976

[54] TOOLS FOR IMPRINTING NON-REPEATING STONE PATTERNS IN FRESH CONCRETE

[75] Inventor: Bradshaw Bowman, Carmel, Calif.

[73] Assignee: Bomanite Corporation, Palo Alto, Calif.

[22] Filed: Oct. 17, 1974

[21] Appl. No.: 515,510

Related U.S. Application Data

[60] Division of Ser. No. 459,266, April 9, 1974, Pat. No. 3,887,293, which is a continuation-in-part of Ser. No. 288,672, Sept. 13, 1972, Pat. No. 3,807,888.

[52] U.S. Cl. ..... 404/93

[51] Int. Cl.[2] ..... E01C 23/16

[58] Field of Search ..... 404/72, 93, 94, 97; 425/469

[56] References Cited

UNITED STATES PATENTS

| | | | |
|---|---|---|---|
| 881,001 | 3/1908 | Johnson | 425/469 |
| 967,714 | 8/1910 | Blome et al. | 404/93 |
| 1,063,752 | 6/1913 | Walung | 404/93 |
| 3,406,618 | 10/1968 | Bowman | 404/72 |

*Primary Examiner*—Mervin Stein
*Assistant Examiner*—Steven Hawkins
*Attorney, Agent, or Firm*—Flehr, Hohbach, Test, Albritton & Herbert

[57] ABSTRACT

A method for forming non-repeating stone patterns in fresh concrete including preparing the surface of the fresh concrete by bullfloating and the addition of color, if desired, imprinting into the fresh concrete indentations representative of the corners only of the stones in the pattern, imprinting separately connecting grooves between the imprinted corners. The method may further include the use of a plastic overlay on the fresh concrete prior to imprinting so as to provide a well rounded edge to the formed stones. A number of tools for forming the non-repeating patterns are also disclosed. One of such tools is a walking tool including a flat platform having a plurality of apertures, a shaft rotatably extended through each aperture, a hub on each shaft below the platform on which the platform rests, a flange on each shaft engaging the top of the platform, a plurality of imprinting blades extending from each hub to form a group, the top of each shaft having an anvil head to be pounded, and at least one of said apertures being elongated to render one group of blades both rotatably and laterally adjustable for varying the stone patterns to be imprinted in fresh concrete. Other tools suitable for use with the method include an individual group of blades arranged in the form of the corners of the stone to be imprinted, together with a striking area by which the blades can be pounded into the surface of the fresh concrete.

4 Claims, 19 Drawing Figures

TOOLS FOR IMPRINTING NON-REPEATING STONE PATTERNS IN FRESH CONCRETE

BACKGROUND OF THE INVENTION

This application is a division of my copending application, Ser. No. 459,266, filed Apr. 9, 1974 for Method for Imprinting Non-Repeating Stone Patterns in Fresh Concrete and Tools for Use Therein, now U.S. Pat. No. 3,887,293, which was a continuation-in-part of application Ser. No. 288,672, filed Sept. 13, 1972 for Imprinting Tool for Non-Repeating Stone Patterns in Fresh Concrete, now U.S. Pat. No. 3,807,888.

The method and walking tool in U.S. Pat. No. 3,406,618, issued on Oct. 22, 1968 to Bradshaw Bowman, worked eminently for forming a predetermined pattern in concrete. However, problems arose when non-repeating patterns were desired. The fixed pattern of blades on the previous walking tools were incapable of producing non-repeating patterns.

SUMMARY OF THE INVENTION AND OBJECTS

The primary object of this invention is to provide tools wherein groups of blades may be adjusted angularly or rotatably and also laterally relative to each other thereby to combine in producing non-repetitive patterns in fresh concrete. The tool is light in weight and easily manipulated.

A particular object of the invention is to provide a tool which includes a single blade group which can individually be forced into fresh concrete providing a pattern which has the appearance only of the corners of the stones to be laid out.

DETAILED DESCRIPTION OF THE PREFERRED EMBODIMENT

Figure 1:
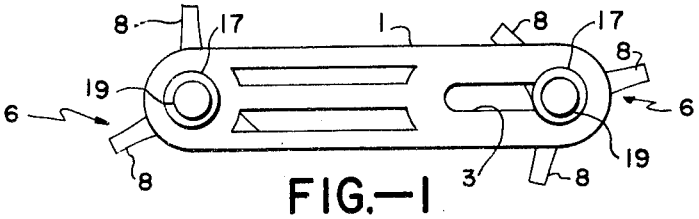
FIG. 1 is a top plan view of a walking tool in accordance with the invention.

The illustrative embodiment of the walking tool herein includes a platform 1 capable of supporting the weight of a workman. The platform 1 is made of a light material such as aluminum and is slotted to reduce weight, and view blades to facilitate positioning same. The platform 1 is elongated in shape and has several journal apertures therethrough, such as a hole 2 near one end thereof, and an elongated aperture 3 near its other end. The aperture 3 is longitudinal on the elongated platform 1.

Blade groups 6 are beneath the platform 1. Each blade group 6 has a hub 7 and three radially extending blades 8. Each blade has downwardly converging sides 9 which taper to a penetrating edge 11.

A ring flange 12 on the top of the blades 8 has spokes 10 along the top of the respective blades connected to the hub 7. The diameter of the ring flange 12 is substantially the same as the width of the elongated platform 1. This prevents the respective blade groups from tilting relatively to the platform and also prevents the blades from being caught in the elongated aperture 3. The groups of blades are interchangeable. A tubular stem 13 extends from the hub 7. The stem 13 rotatably fits into the hole 2 or into the elongated aperture 3. The stem 13 is partially threaded on its outer periphery so as to leave a smooth portion 14 between the hub 7 and the exterior threads, to be journalled in the hole 2 or aperture 3. An internally threaded bushing 16 is threaded on the stem 13 at the top of the platform 1. A flange 17 on the bushing 16 bears against the top of the platform 1 so that the smooth portion 14 is rotatably held in the hole 2 and in the aperture 3. A hollow shaft 18 is screwed into the top of the bushing 16 and an anvil cap 19 is screwed on the upper end of the shaft 18.

Figure 5:
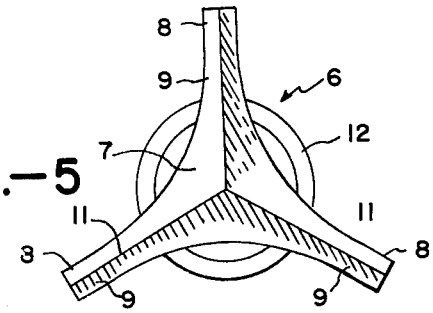
FIG. 5 is a bottom view of one of the blade groups shown in FIGS. 1 through 3.
Figure 6:
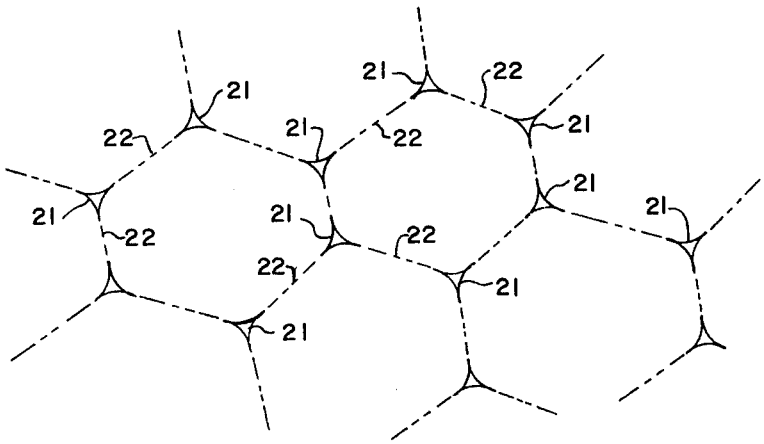
FIG. 6 is an illustrative view of the non-repeating stone patterns produced by the method and tools of the invention.

As shown in FIG. 5, the blade group 6 is made in a triangular star shape with concave connecting sides, which imprint such triangular star shape impression or groove to form a corner imprint 21 as shown in the stone pattern in FIG. 6. This is an illustrative embodiment. After the pattern grooves are imprinted into the fresh concrete, the workman connects the points of the blade imprints, by means of a suitable hand tool, so that the connecting grooves 22 complete the non-repeating stone pattern. Such hand tool is usually a single blade on an anvil shaft.

Figure 4:
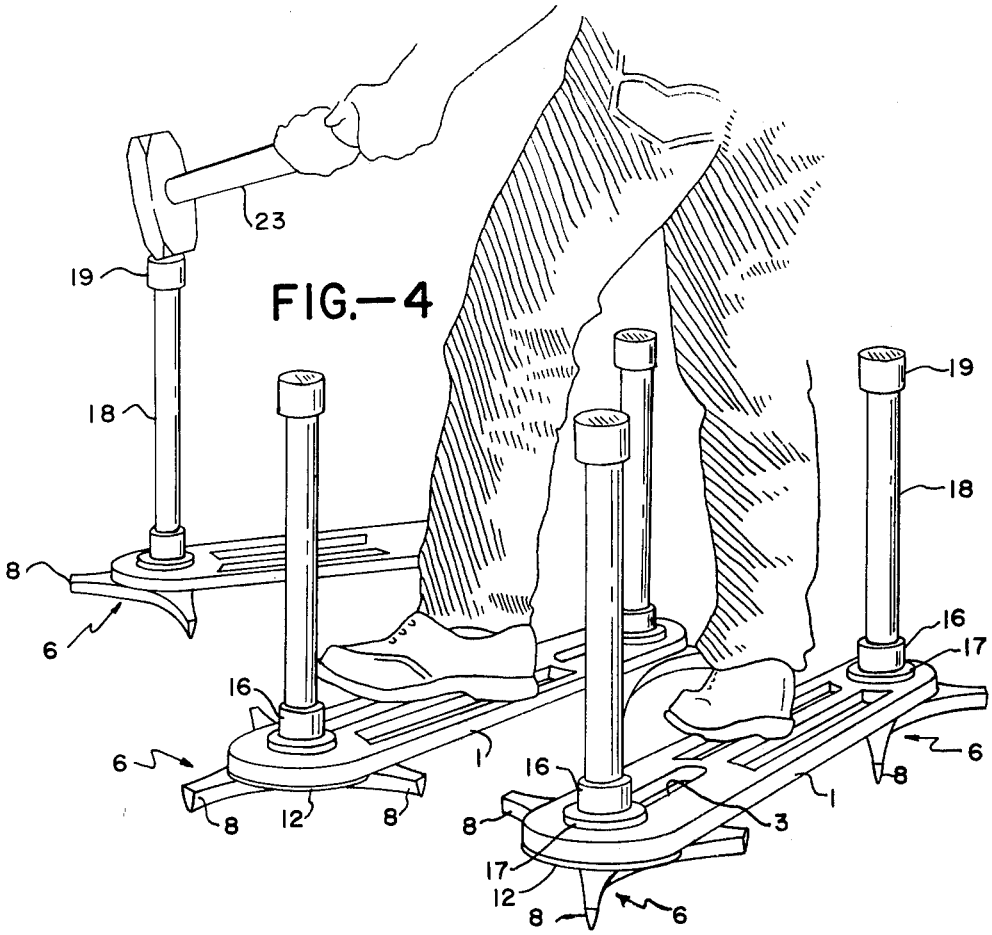
FIG. 4 is a perspective view illustrating the imprinting operation with the walking tool shown in FIGS. 1 through 3.

The operation of this walking tool is shown in FIG. 4. Usually the workman uses several units. The workman stands on one or two platforms and pounds with a sledge hammer 23 or the like, on the anvil 19 of the shaft 18. Then the workman rests one blade group on the concrete slab and lifts the other end of the platform so as to lift the other blade group off the slab and rotates the same until the desired offset is reached and then lowers it on the slab. In addition, while the blade group under the elongated apertures 3 is off the concrete slab the workman may slide it to suitably change the spacing. After the walking tool is so adjusted on the fresh concrete, the workman pounds on the respective anvil heads 19 of both blade groups thereby to form the design in the fresh concrete. Then with a hand tool the workman connects the respective corners or apices of the adjacent triangular imprints. This arrangement forms the stone pattern in such a manner that there is no continuous line beyond any corner imprint. Each corner imprint 21 forms a joint always outlining an individual stone pattern.

Figure 2:
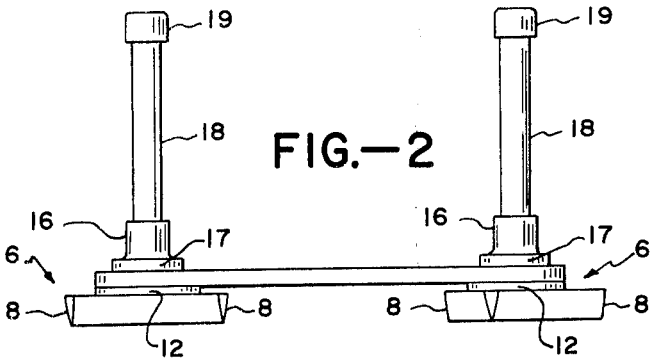
FIG. 2 is a side view of the walking tool shown in FIG. 1.
Figure 3:
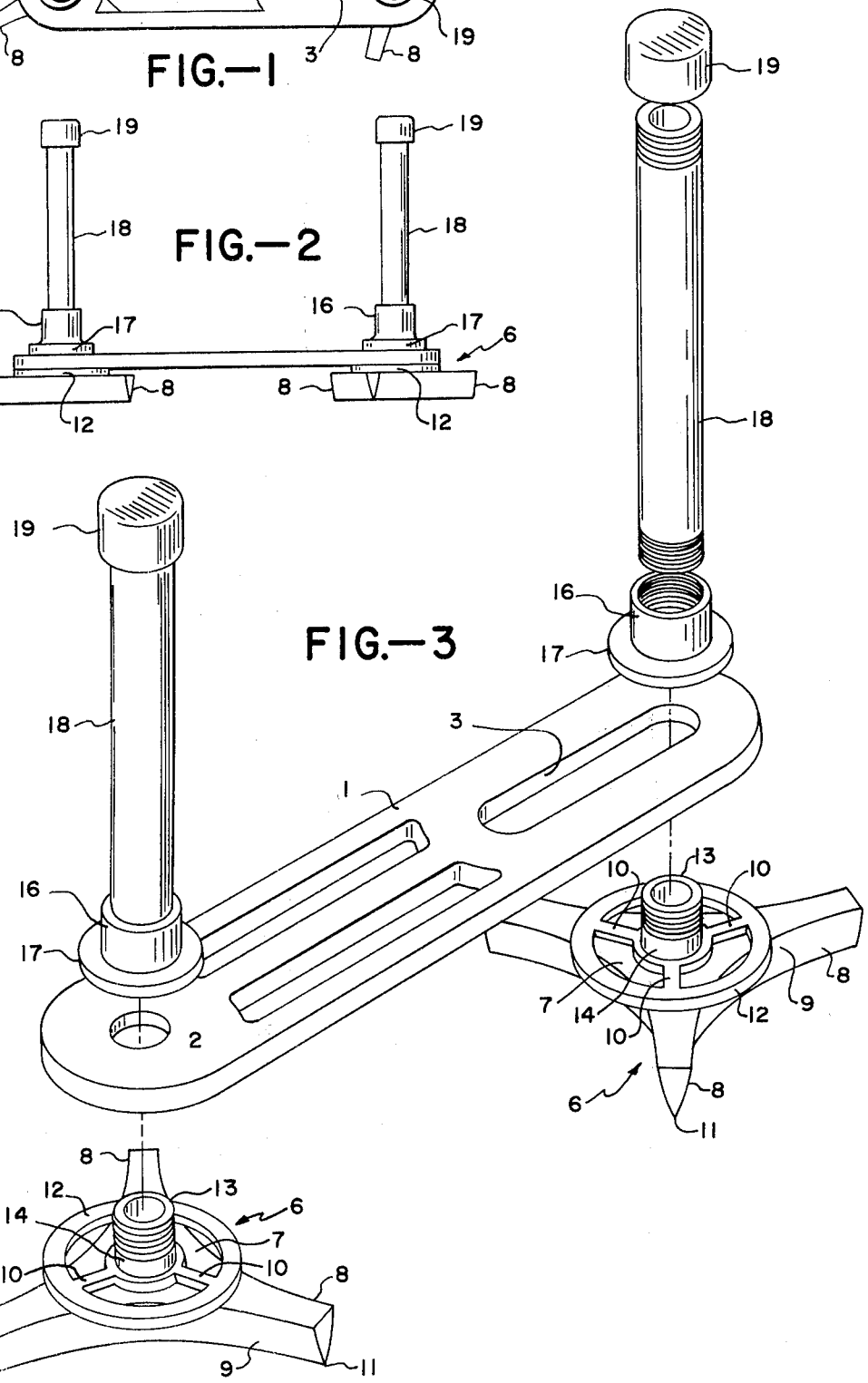
FIG. 3 is a developed perspective view of parts of the walking tool shown in FIGS. 1 and 2.
Figure 7:
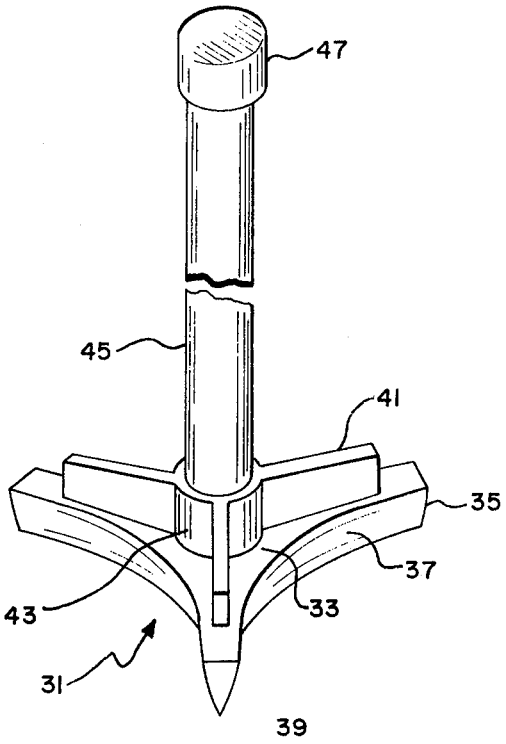
FIG. 7 is a perspective view of a single blade group tool in accordance with the invention for imprinting one group of interconnected corners of the stone pattern.

Rather than use the platform walking tools, shown in FIGS. 1 to 3, an individual tool for imprinting the corners, such as that shown in FIG. 7 may be employed. The tool of FIG. 7 includes but a single blade group 31 which is formed with a hub 33 and radially extending blades 35. As in the tool shown in FIGS. 1 to 3, each blade 35 has downwardly converging sides 37 which taper to a penetrating edge 39.

The tool of FIG. 7 also includes radially extending reinforcing ribs 41 which not only serve to strengthen the blade group 31 itself but also to act as an alternative surface upon which the blade group may be hammered or pounded into the fresh concrete. The reinforcing ribs 41 converge to form an internally threaded collar 43 which receives a shaft 45 having an anvil cap 47 secured to the top thereof.

A bottom view of the tool shown in FIG. 7 is identical to FIG. 5 except for the elimination of the ring flange 12.

Figure 8:
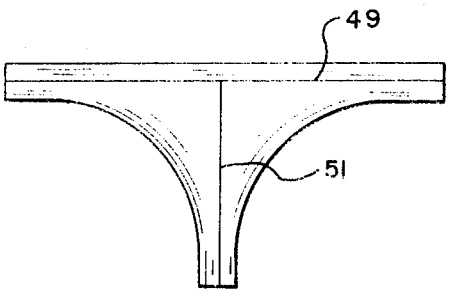
FIG. 8 is a bottom view of a blade group which may be used either in the tool shown in FIGS. 1 through 3 or in the tool shown in FIG. 7.

The star shaped blade group need not be the equiangular triangular star shape of the tools described thus far. Rather, it may be in the form of a T, such as shown in FIG. 8, including one penetrating edge 49 intersected at substantially a right angle by a second penetrating edge 51. Another variation is the tool shown in FIG. 9 which, although still of the triangular star shape, is not equiangular as that shown in FIG. 5 but rather includes wide angle penetrating edges 53 and 55 each forming a smaller angle with penetrating edge 57.

Figure 9:
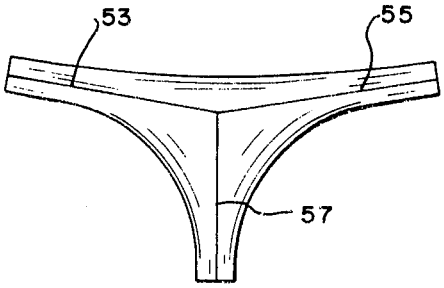
FIG. 9 is a view similar to FIG. 8 but showing an angular tool having configurations somewhat in between that of the T-shape shown in FIG. 8 and the equiangular star shown in FIG. 5.

The use of tool shapes, as shown in FIGS. 8 and 9 in conjunction with that shown in FIG. 5, provides a more versatile combination of patterns as will be seen hereinafter. Still additional shapes may be usefully employed such as an exceptionally narrow angle triangle or an L-shape tool for specific purposes.

Figure 10:
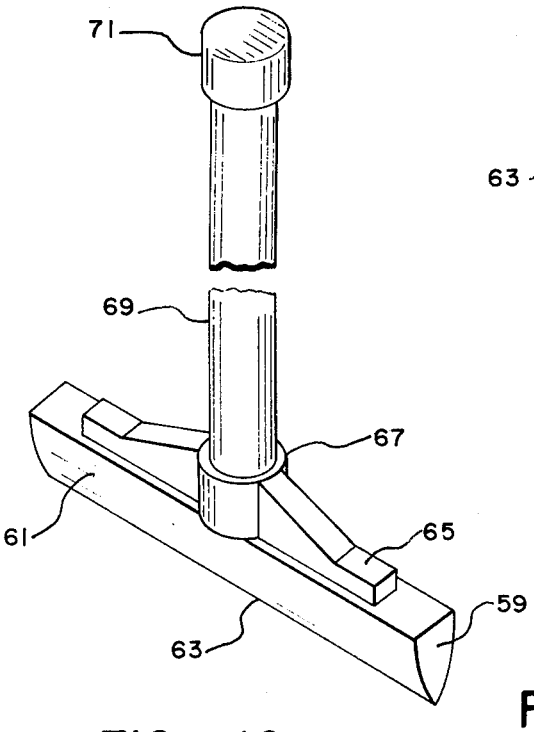
FIG. 10 is a perspective view of a tool used in accordance with the invention to imprint into fresh concrete the grooves interconnecting the various corners which may have been imprinted by the tools of FIGS. 1 through 3, or FIG. 7.
Figure 11:
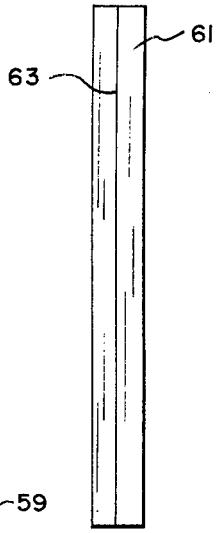
FIG. 11 is a bottom view of the tool shown in FIG. 10.

In order to complete the connecting grooves, a tool such as shown in FIGS. 10 and 11 is employed. This tool includes a single blade 59 having downwardly converging sides 61 terminating in a straight penetrating edge 63. A strengthening rib 65 may be included along the top of the blade, the rib 65 being joined to a collar 67 in the center of the tool. Collar 67 is threaded and receives a shaft 69 terminated at its upper end with an anvil 71. The operation of the tool, shown in FIGS. 10 and 11, is similar to that of the previously described tool of FIG. 7 such that the blade 59 is penetrated into the fresh concrete by hammering or pounding either on the anvil 71 or on the reinforcing rib 65.

Figure 12:
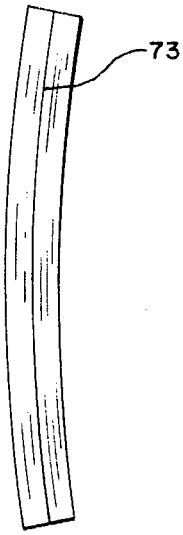
FIG. 12 is a bottom view similar to FIG. 11 but showing a tool having an alternative shape for interconnecting the various corners.

Rather than the connecting groove tool being absolutely straight, as shown in FIGS. 10 and 11, the tool may take the form of a slight curve so as to provide a still more naturally shaped stone. The bottom view of such a curved tool is shown in FIG. 12 wherein penetrating edge 73 is in the form of a slight arch, rather than in a straight line as is the penetrating edge 63 of the previously described tool. In all other respects the tool of FIG. 12 is identical to that shown in FIGS. 10 and 11.

Figure 13:
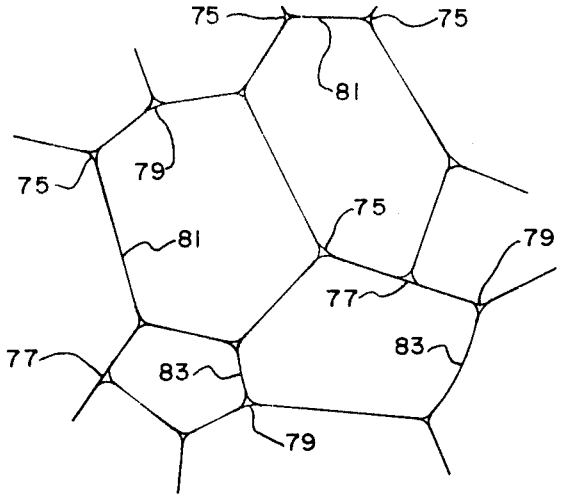
FIG. 13 is a view similar to FIG. 6 but showing non-repeating stone patterns which may be produced by utilizing tools of various shapes such as shown in FIGS. 7, 8 and 9.

Referring specifically to FIG. 13, there is shown a stone pattern formed by using several different tools as shown in FIGS. 8 and 9 as well as shown in FIGS. 7 and 5, it being recognized that tools having the shape of those shown in FIGS. 8 and 9 may be employed with the platform shown in FIGS. 1 through 3, or in the single blade group tool shown in FIG. 7. In the pattern shown in FIG. 13 corner imprints 75 are produced by using an equiangular star shape shown in FIG. 5 while corners 77 are made by the T-shaped tool of FIG. 8 and corners 79 by the open wide tool of FIG. 9. With the additional shaped tools a wider variety of non-repetitive pattern can be easily produced. In the pattern of FIG. 13 the interconnecting grooves 81 are formed with the tools shown in FIGS. 10 and 11 but slightly curved or rounded interconnecting grooves 83 may be formed with the tool shown in FIG. 12.

Figure 14:
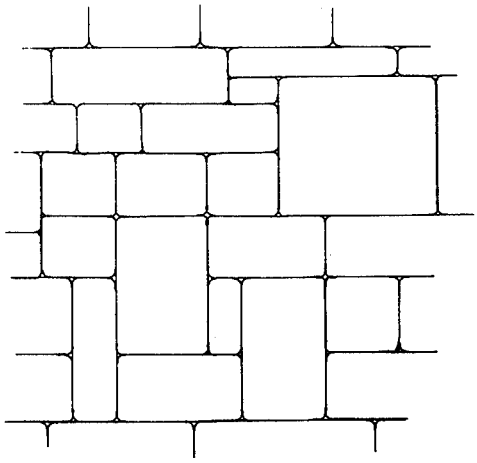
FIG. 14 is another view similar to FIG. 6 but showing a non-repeating stone pattern which may be produced solely by use of a T-shaped tool such as shown in FIG. 8.

Still another stone pattern is shown in FIG. 14 wherein a T-shaped tool, as shown in FIG. 8, is employed for all the corners. With this arrangement a non-repeating pattern of rectangular stones such, for instance, as flag stone, may easily be accomplished.

Figure 15:
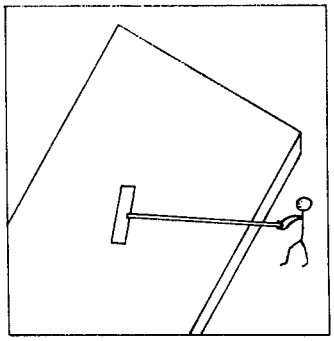
FIG. 15 is a perspective diagramatic view showing the final preparation of the fresh concrete surface prior to employing the method of the invention herein.
Figure 16:
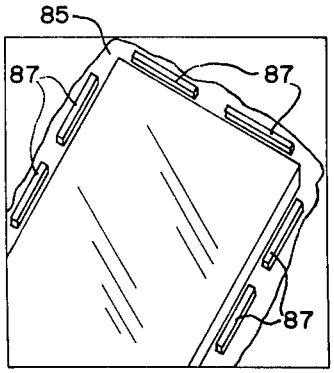
FIG. 16 is a perspective diagramatic view illustrating an optional step in the method of invention of laying a sheet of plastic over the fresh concrete prior to imprinting.

Referring to FIGS. 15 through 19, the method of imprinting the non-repeating stone patterns in the concrete is shown. Referring specifically to FIG. 15, there is shown a freshly poured concrete which may be poured, screeded, leveled, bull-floated and colored all in accordance with the teachings of Bowman U.S. Pat. No. 3,406,618, issued Oct. 22, 1968. However, rather than continuing the method as shown in that earlier patent, the remainder of the steps are in accordance with the present invention. Specifically in FIG. 16, the still freshly poured concrete is covered with a sheet 85 of plastic. A suitable plastic is a 1 mil thick film of polyethylene, such as that manufactured by Visking Company, Division of Union Carbide Corporation, under the trademark VISQUEEN. The use of the plastic is an option which provides more rounding of the edges and corners of the imprinted stone than would be if the plastic were eliminated. Generally the plastic sheet 85 is held in place by spare lumber pieces 87 and is generally smoothed to eliminate air pockets underneath.

Figure 17:
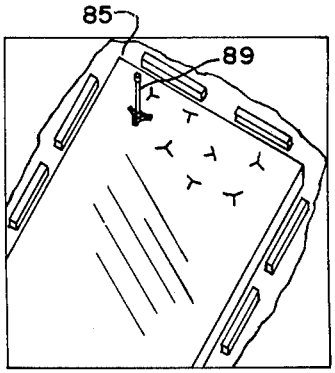
FIG. 17 is a perspective diagramatic view illustrating the imprinting into the fresh concrete corners of the various stones to be included in the pattern.

Referring to FIG. 17, the corner imprinting tools shown generally as 89, are employed to make the impressions of corners such, for instance, as shown at 75, 77 and 79 of FIG. 13. The tools 89 are shown only generally and may either be of the platform type shown in FIGS. 1 through 3 or the individual type as shown in

FIG. 7.

Figure 18:
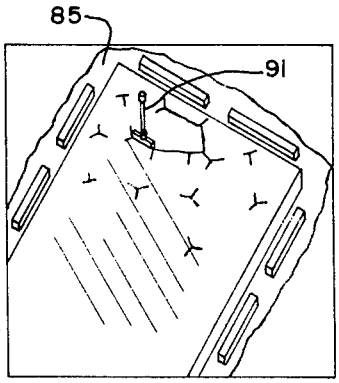
FIG. 18 is a perspective diagramatic view showing the imprinting of interconnecting grooves between the corners.
Figure 19:
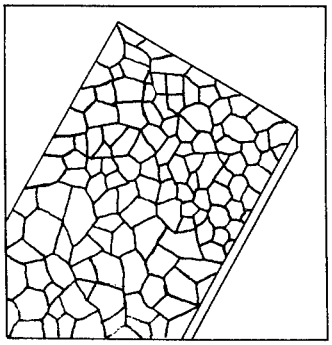
FIG. 19 is a perspective diagramatic view showing the finished surface of the concrete in the form of a non-repeating star pattern.

Referring to FIG. 18, the tools 91 of the general type shown in FIG. 10 are employed to imprint the interconnecting grooves between the various corners. After the interconnecting grooves are imprinted, the plastic sheet 85 may be removed and the finished slab, such as shown in FIG. 19, is allowed to season.

I claim:

1. A tool for forming stone patterns in fresh concrete in non-repeating patterns consisting of a single blade group, said glade group including a plurality of blades all of which are joined together at a common point and forming that part of the pattern comprising the corners of the stones in the stone pattern, each blade of the group having sides downwardly converging to a penetrating edge, the penetrating edges of each of said blades defining a plane, and a shaft on the blade group extending upward generally normally from said plane.

2. A tool as defined in claim 1, wherein the blades of said group are generally radial relative to said shaft.

3. A tool as defined in claim 2 wherein the radially extending blades are spaced equiangularly from each other.

4. A tool as defined in claim 1 wherein said blades form a right angle with each other.

* * * * *